US007188565B2

(12) United States Patent
Chen

(10) Patent No.: US 7,188,565 B2
(45) Date of Patent: Mar. 13, 2007

(54) FLEXOGRAPHY INK ROLLER UNIT

(75) Inventor: Chih-Wang Chen, Taoyuan Hsien (TW)

(73) Assignee: Sunrise Pacific Co., Ltd., Taoyuan Hsien (TW)

( * ) Notice: Subject to any disclaimer, the term of this patent is extended or adjusted under 35 U.S.C. 154(b) by 0 days.

(21) Appl. No.: 11/143,445

(22) Filed: Jun. 3, 2005

(65) Prior Publication Data

US 2006/0272526 A1 Dec. 7, 2006

(51) Int. Cl.
*B41F 31/32* (2006.01)
*B41F 31/30* (2006.01)

(52) U.S. Cl. ..... 101/351.1; 101/352.01

(58) Field of Classification Search ..... 101/350.1, 101/351.1, 351.3, 351.4, 352.01, 352.04, 101/352.05, 350.6, 480
See application file for complete search history.

(56) References Cited

U.S. PATENT DOCUMENTS

| | | | | |
|---|---|---|---|---|
| 3,306,197 | A * | 2/1967 | Jensen et al. | 101/212 |
| 4,150,621 | A * | 4/1979 | Raible | 101/207 |
| 4,370,926 | A * | 2/1983 | Hattori | 101/207 |
| 5,081,928 | A * | 1/1992 | Harrison | 101/351.4 |
| 5,154,602 | A * | 10/1992 | Harrison | 101/351.3 |
| 6,101,940 | A * | 8/2000 | Huff | 101/213 |
| 6,293,195 | B1 * | 9/2001 | Allison, Jr. | 101/350.6 |

* cited by examiner

*Primary Examiner*—Ren Yan
*Assistant Examiner*—Leo T. Hinze
(74) *Attorney, Agent, or Firm*—Troxell Law Office PLLC

(57) ABSTRACT

A ink roller unit comprised of multiple ink rollers axially arrange in parallel on a turntable unit; the turntable unit being provided to a dancer; one end of the dancer being pivoted to a lateral shaft and the other end coupled to a drive unit; the dancer as driven swinging at a given angel along the lateral shaft; the turntable in turn changing its location to get near to that of the printing roller or not to facilitate selection of other ink rollers to execute the printing job.

5 Claims, 6 Drawing Sheets

FLEXOGRAPHY INK ROLLER UNIT

BACKGROUND OF THE INVENTION (a) Field of the Invention

The present invention is related to a flexography ink roller unit, and more particularly to one comprised of multiple ink rollers available for selection depending on the operation needs to bind flushed against the print roller to execute printing job.

(b) Description of the Prior Art

In flexography, the ink is usually transferred to print on the printed matter by taking advantage of an ink roller and a rubber made ink wipe roller or a scraper to scrape excessive ink before transfer of ink to the flexography plate. As illustrated in FIG. 1 of the accompanying drawings, a flexography plate 20 is mounted to a printing roller 11, and an ink roller 12 is adapted to work with the flexography plate 20 and an ink device 13 is provided to contact the ink roller 12. Both of the ink roller 12 and the printing roller 11 roll synchronously to transfer the ink on the ink device 13 to the printed matter fed on a cylinder. This type of printing is particularly applicable to print massive and larger size printed matters at high speed.

In the course of the operation of flexography, the given mesh of the ink roller 12 is used to control the ink containment of the flexography plate. Therefore, other than the selection of an ink roller 12 depending on the nature of the printed matter, a specific flexography plate must be mounted to the printer achieve the expected printing quality. However, the conventional half-tone printer is adapted with only one ink roller 12. Once the change of the ink containment is desired, the existing ink roller must be removed to mount the right ink roller. The replacement causes the preparation work to get complicated thus to prevent a fast replacement, and the ink roller may be damaged due to the frequent replacement.

SUMMARY OF THE INVENTION

The primary purpose of the present invention is to provide a flexography ink roller unit comprised of multiple ink rollers axially arrange in parallel on a turntable unit. The turntable unit is provided to a dancer. One end of the dancer is pivoted to a lateral shaft and the other end of the dancer is coupled to a drive unit. The dancer as driven by the drive unit swings at a given angel along the lateral shaft. The turntable in turn changes its location to get close to or away from that of the printing roller thus to facilitate the selection of other ink rollers to execute the printing job.

DETAILED DESCRIPTION OF THE PREFERRED EMBODIMENTS

Figure 1:
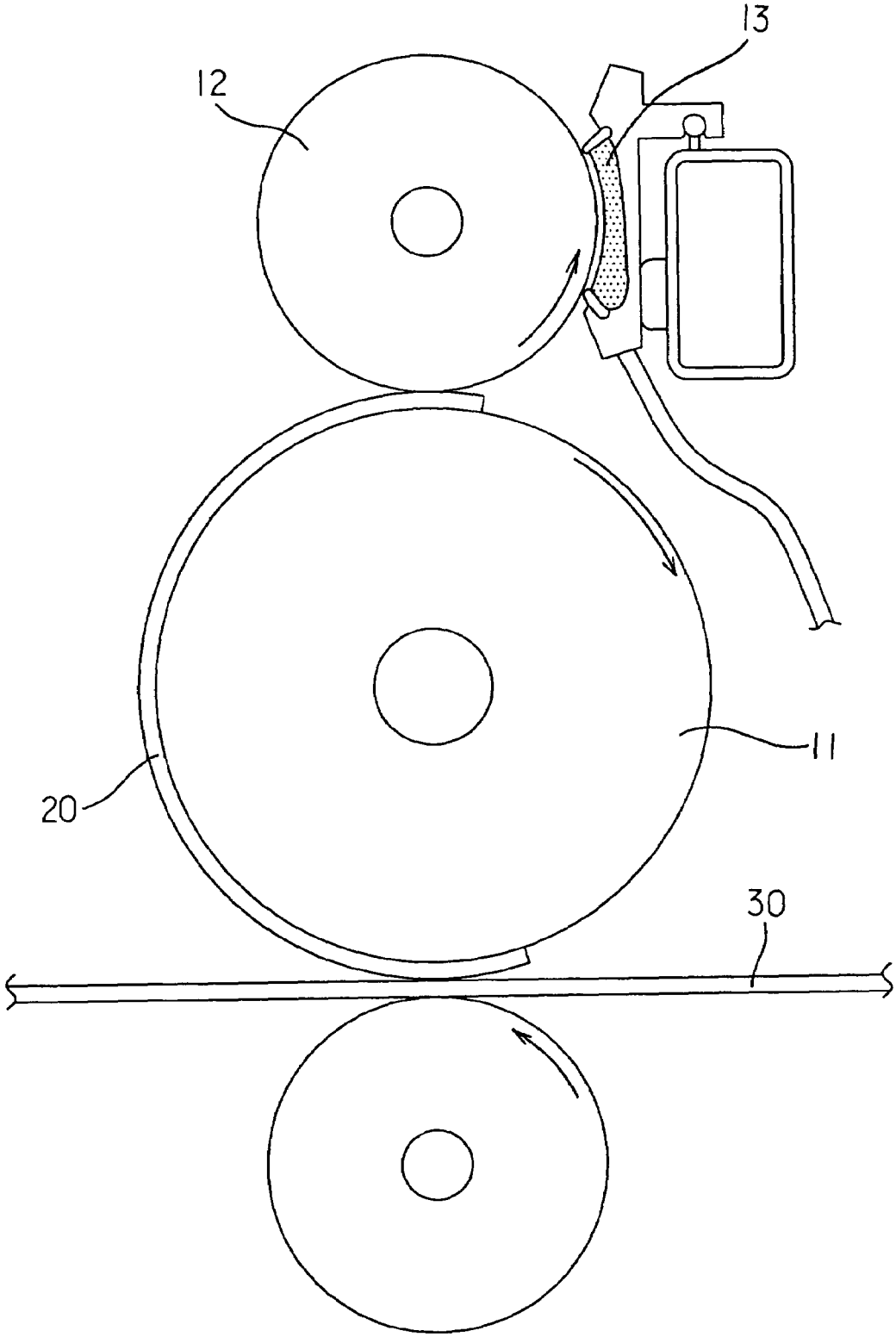
FIG.1 Prior Art
FIG. 1 is a schematic view showing a construction of a flexography machine of the prior art.
Figure 2:
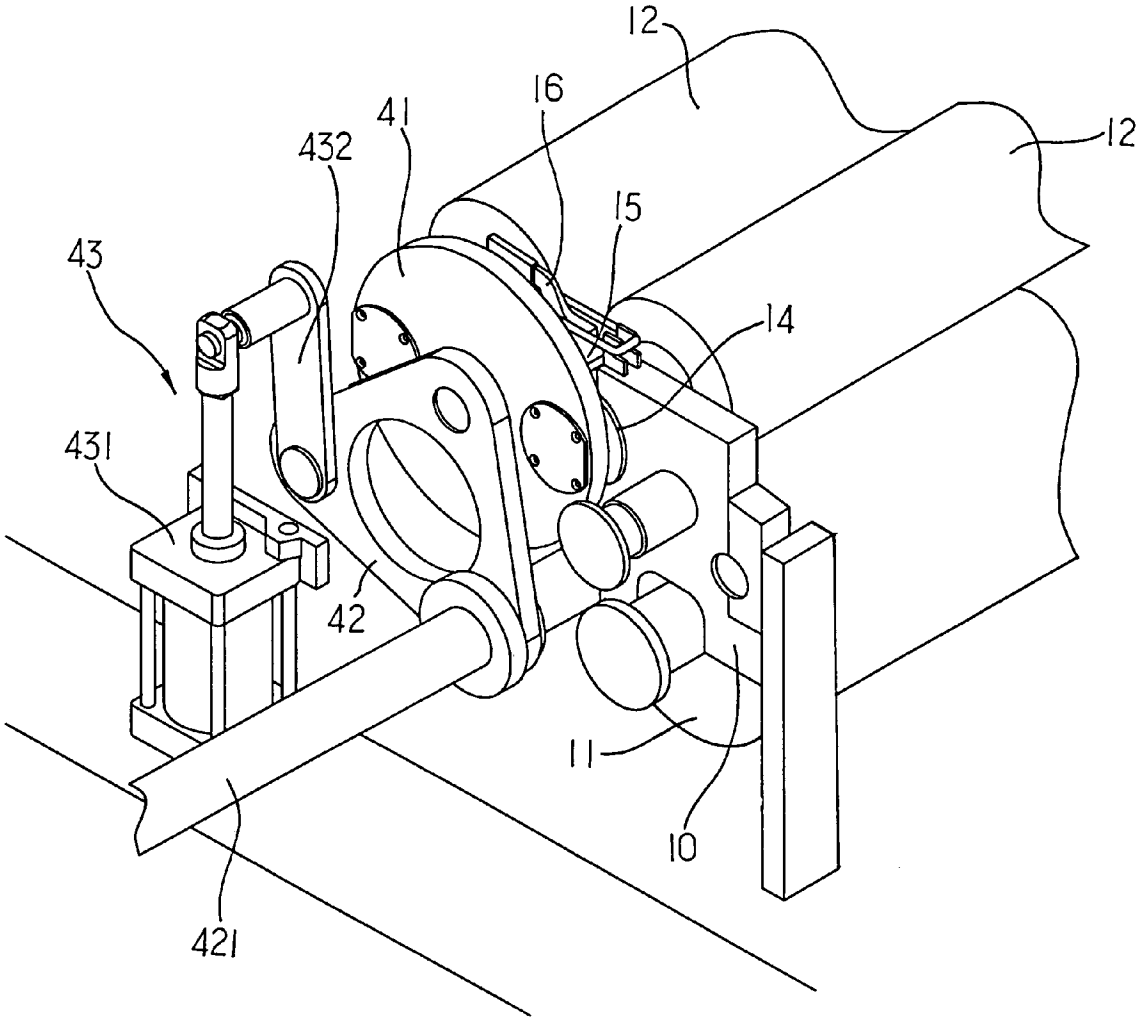
FIG. 2 is a perspective view of a preferred embodiment of the present invention.
Figure 3:
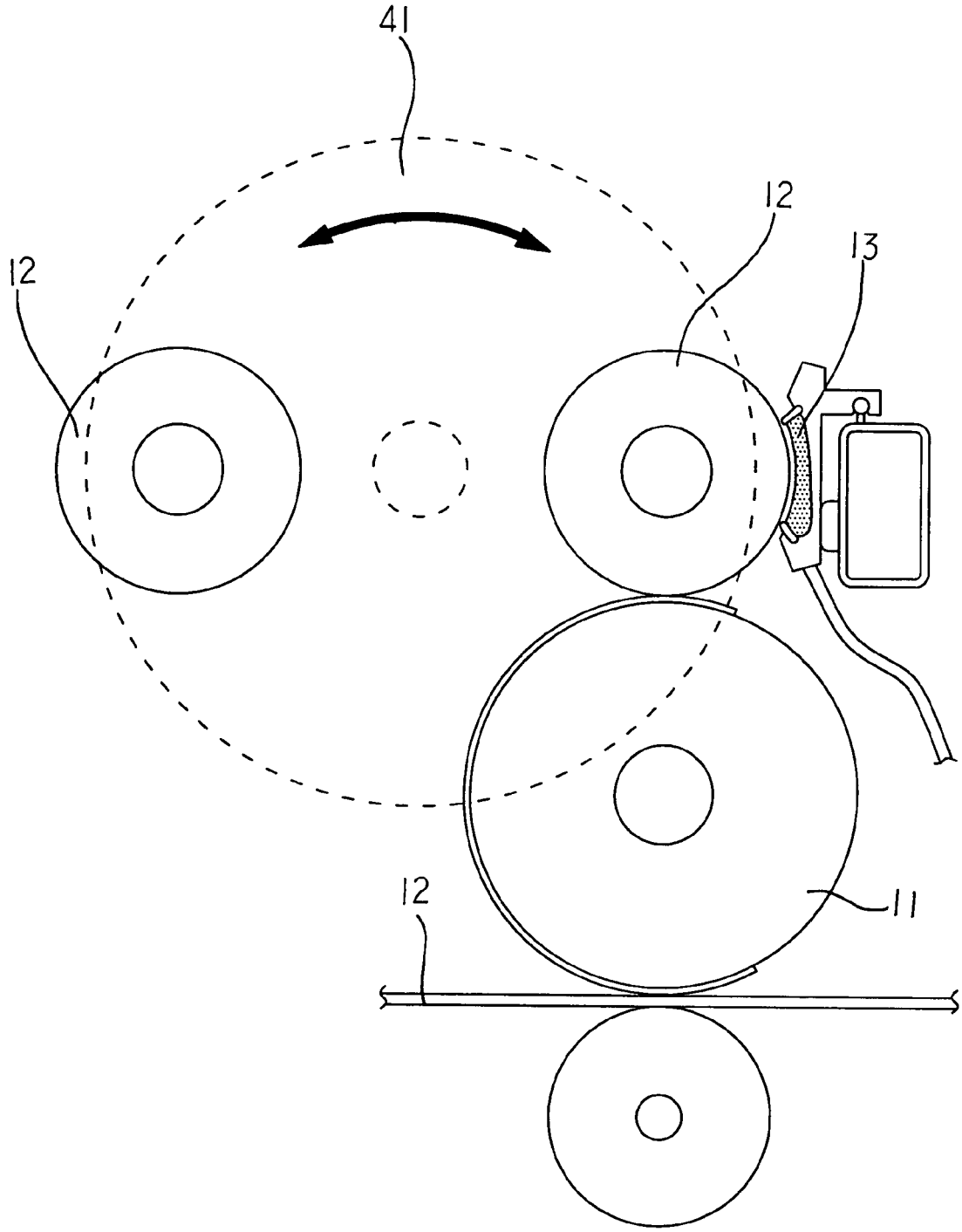
FIG. 3 is a schematic view showing that multiple ink rollers bind flushed against a printing roller in the preferred embodiment of the present invention.

Referring to FIGS. 2 and 3, a flexography ink roller unit of the present invention is essentially comprised of a turntable unit 41, a dancer 42, and a drive unit 43. Wherein, the turntable unit 41 is adapted to the axial end of a printing roller 11 and further coupled to a console 10 of a printing machine by means of the dancer. Two or more than two ink rollers 12 are axially provided to the turntable unit 41 in parallel to each other. One end of the dancer 42 is pivoted to the console 1Q through a lateral shaft 421 and the other end of the dancer 42 is coupled to the drive unit 43. In the preferred embodiment of the present invention as illustrated, the drive unit 43 relates to a member that contains a power cylinder 431 to drive the dancer 42 to operate, and a connection rod 432 connects the power cylinder 431 and the dancer 42. Accordingly, with the telescopic action from the power cylinder 431, the dancer 42 is synchronously driven to swing along the lateral shaft 421 at a given angle, thus for the turntable 41 connected to the dancer 42 to change its location to get closer or away from the printing roller 11 in responding to the swing of the dancer 42.

Figure 4:
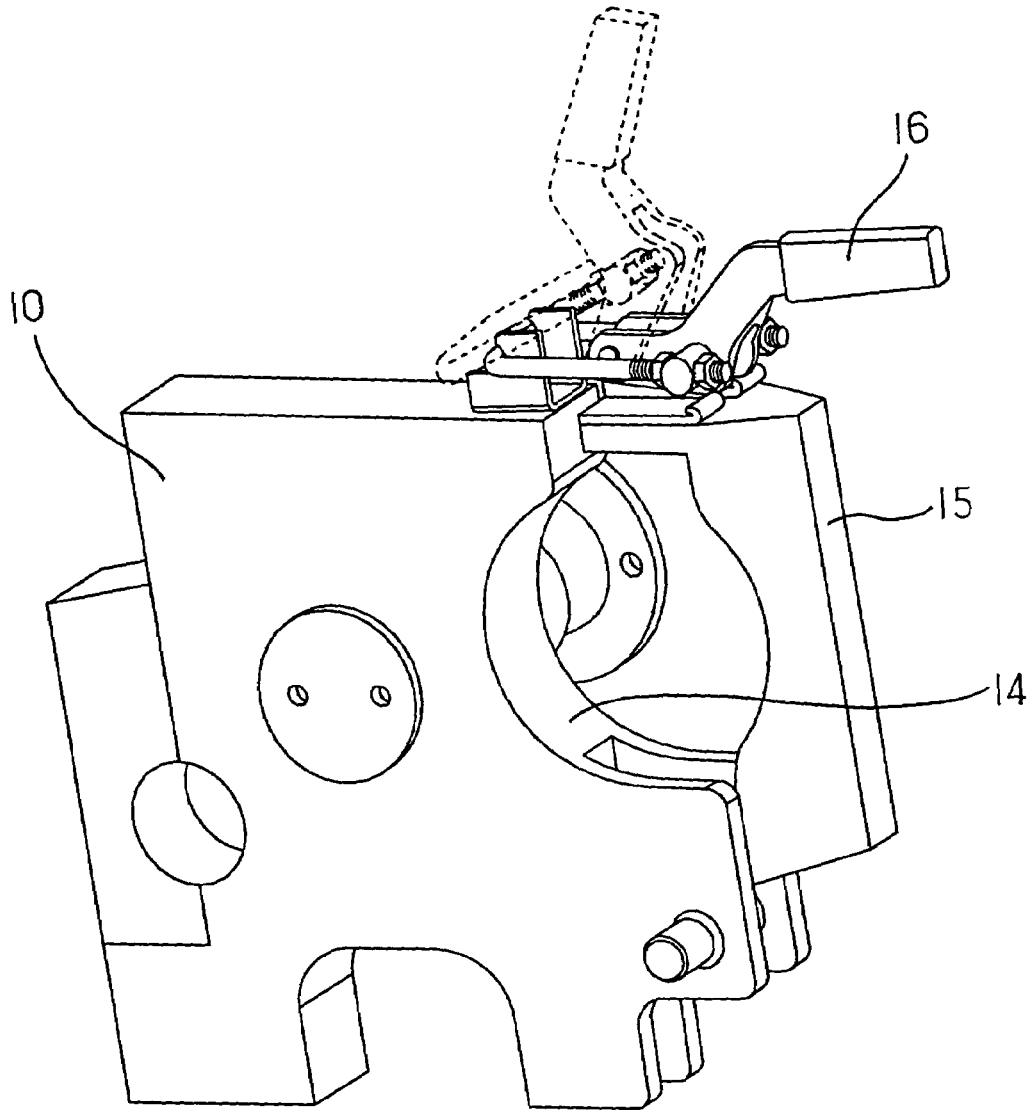
FIG. 4 is a perspective view of a fast wrench contained in the preferred embodiment of the present invention.

Furthermore, a recessed base 14 to permit the entry by the ink roller 12 is provided on the console 10 at where in relation to the shaft end when the ink roller 12 binds flushed against the printing roller 11 as illustrated in FIGS. 3 and 4. A mobile member 15 is provided at the opening of the recessed base to cover up the opening. One end of the mobile member 15 is pivoted to the console 10 and the other end of the mobile member 15 is latched to the console by means of a fast wrench 16.

Figure 5:
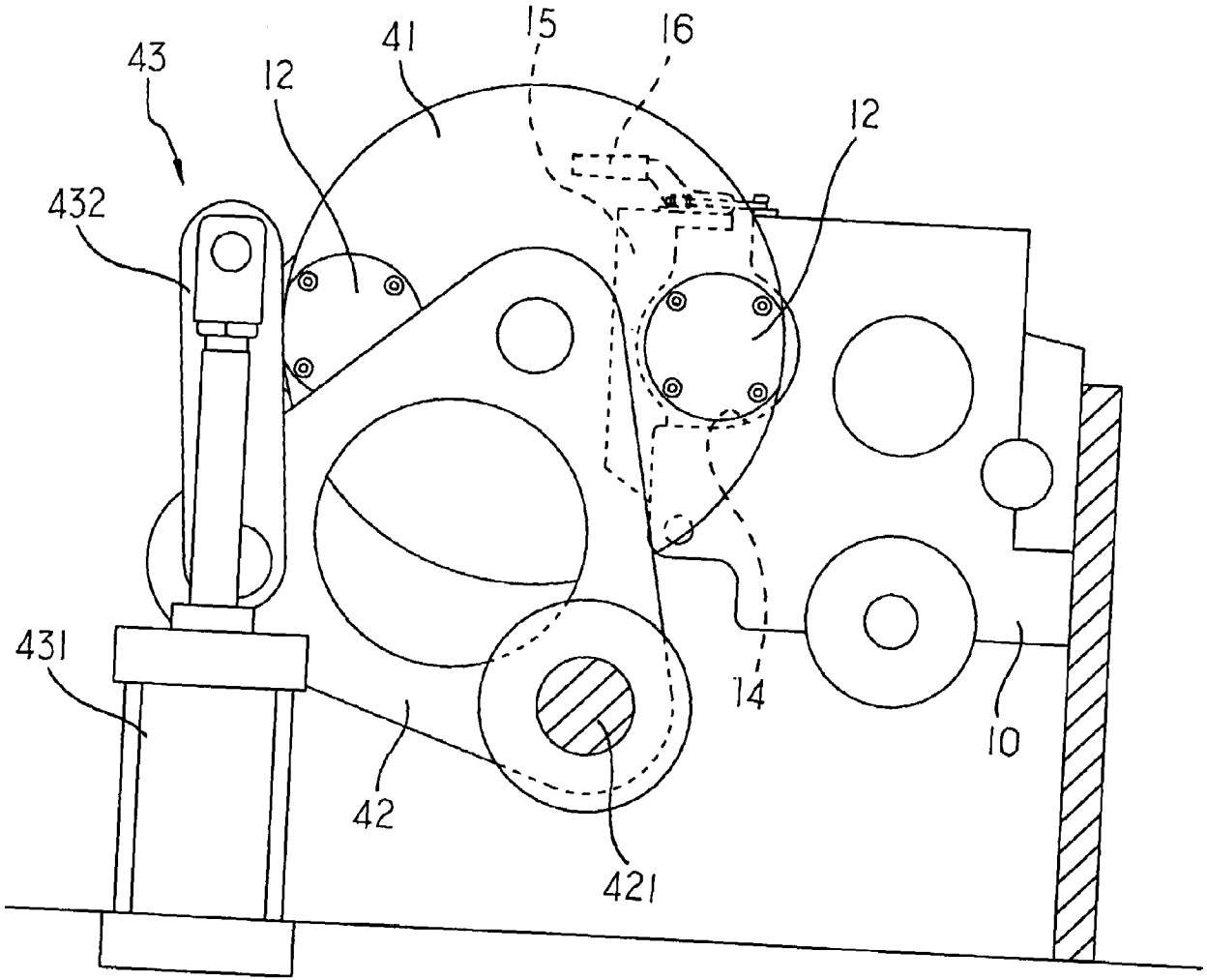
FIG. 5 is a schematic view showing that mobile members of the preferred embodiment of the present invention cover up the opening of a recessed base.
Figure 6:
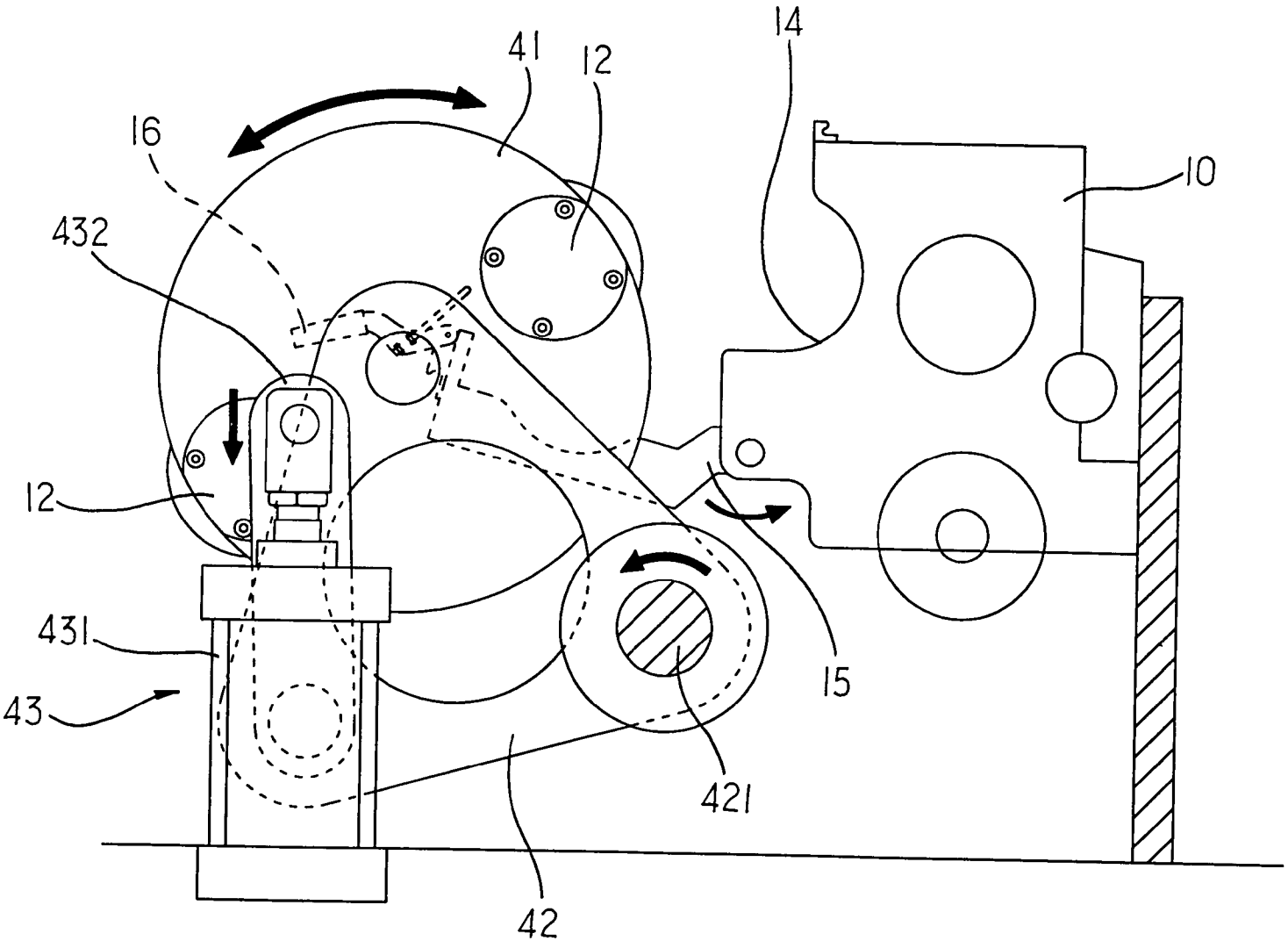
FIG. 6 is a schematic view showing that the preferred embodiment of the present invention is in operation.

As illustrated in FIG. 5, when the ink roller 12 reaches at a location to bind flushed against the printing roller 12, enter into the recessed base 14, and get secured in position therein. The mobile member 15 covers up the opening of the recessed base to avoid the ink roller 12 from falling out of position. If the replacement of the ink roller is desired, the fast wrench is released to clear the mobile member 15 away from the opening of the recessed base. As illustrated in FIG. 6, the drive unit 43 drives the turntable to move away from in the direction of the printing roller to exit the ink roller out of the recessed base 14. Therefore, without the necessity to remove the ink roller, the operator may select another ink roller to work by compromising the printing roller 11 by simply turning around the turntable to simplify the preparation work in flexography and to effectively minimize damage to the ink roller.

The prevent invention provides an improved construction of an ink roller unit that significantly simplified the preparation works in flexography by allowing selecting a proper ink roller to execute printing job without removing any ink roller and that effectively reduce the damage to the ink roller, therefore this application for a utility patent is duly filed accordingly. However, it is to be noted that that the preferred embodiments disclosed in the specification and the accompanying drawings are not limiting the present invention; and that any construction, installation, or characteristics that is same or similar to that of the present invention should fall within the scope of the purposes and claims of the present invention.

I claim:

1. A flexography ink roller unit for a flexography machine comprising:

a) a console having a print roller;

b) a turn table unit;

c) at least two ink rollers rotatably connected to the turn table unit and extending parallel therefrom;

d) a lateral shaft connected to the console;

e) a drive unit; and f) a dancer connected to the turn table at a first connecting point thereof, pivotally connected to the console by the lateral shaft at a second connecting point thereof, and pivotally connected to the drive unit at a third connecting point thereof, the drive unit selectively moving the dancer around the lateral shaft.

2. The flexography ink roller unit according to claim 1, wherein the drive unit having:

a) a power cylinder controlling a movement of the dancer; and b) a connection rod connecting the power cylinder to the dancer.

3. The flexography ink roller unit according to claim 1, wherein the console has a recessed base, when a first ink roller is located adjacent to the printing roller the first ink roller is located in the recessed base.

4. The flexography ink roller unit according to claim 3, further comprising a mobile member selectively locking the first ink roller in the recessed base.

5. The flexography ink roller unit according to claim 4, further comprising a fastening wrench, the mobile member having a first end pivotally connected to the console and an a second end selectively connected to the console by the fastening wrench.

* * * * *